US011284186B2

(12) United States Patent
Proni et al.

(10) Patent No.: US 11,284,186 B2
(45) Date of Patent: Mar. 22, 2022

(54) VENTED LOUDSPEAKER

(71) Applicants: Lucio Proni, Weston, FL (US); Dwayne Spanbroek, Boca Raton, FL (US); Stephen D. Ponte, Davie, FL (US)

(72) Inventors: Lucio Proni, Weston, FL (US); Dwayne Spanbroek, Boca Raton, FL (US); Stephen D. Ponte, Davie, FL (US)

(73) Assignee: JL Audio, Inc., Miramar, FL (US)

( * ) Notice: Subject to any disclaimer, the term of this patent is extended or adjusted under 35 U.S.C. 154(b) by 844 days.

(21) Appl. No.: 16/111,390

(22) Filed: Aug. 24, 2018

(65) Prior Publication Data

US 2020/0068291 A1 Feb. 27, 2020

(51) Int. Cl.

| | |
|---|---|
| ***H04R 1/28*** | (2006.01) |
| ***H04R 9/06*** | (2006.01) |
| ***H04R 9/04*** | (2006.01) |

(52) U.S. Cl.

CPC ..... *H04R 1/2849* (2013.01); *H04R 1/2834* (2013.01); *H04R 9/042* (2013.01); *H04R 9/045* (2013.01); *H04R 9/06* (2013.01)

(58) Field of Classification Search

CPC .... H04R 1/2849; H04R 1/2834; H04R 9/042; H04R 9/045; H04R 9/06

USPC ..... 181/148

See application file for complete search history.

(56) References Cited

U.S. PATENT DOCUMENTS

| | | | | |
|---|---|---|---|---|
| 8,126,188 | B2 * | 2/2012 | Takase | H04R 31/006 381/396 |
| 2006/0159296 | A1 * | 7/2006 | Kobayashi | H04R 5/02 381/300 |
| 2006/0198547 | A1 * | 9/2006 | Hampton | H04R 1/023 381/395 |
| 2008/0317255 | A1 * | 12/2008 | Cozens | H04R 9/10 381/71.6 |
| 2011/0235845 | A1 * | 9/2011 | Wang | H04R 1/26 381/386 |
| 2011/0261986 | A1 * | 10/2011 | Murayama | G01M 3/26 381/332 |

* cited by examiner

*Primary Examiner* — Sean H Nguyen

(74) *Attorney, Agent, or Firm* — Donald S. Showalter, Esq.; GrayRobinson, P.A.

(57) ABSTRACT

A loudspeaker comprises a one-piece frame integrally molded with a venting element which is located within a vent passage extending between the frame interior and a frame flange adapted to mount to a panel of an enclosure or to a baffle wherein pressurized air created by exposure of the enclosure and loudspeaker to elevated temperatures may escape from the enclosure through a leak path formed by the vent passage and the venting element.

16 Claims, 7 Drawing Sheets

VENTED LOUDSPEAKER

FIELD OF THE INVENTION

This invention relates to loudspeakers, and, more particularly, to a loudspeaker having a one-piece frame integrally molded with a venting element which is located within a vent passage formed in the frame wherein pressurized air created by the application of heat to an enclosure within which the loudspeaker is housed may escape from the enclosure interior through a leak path formed by the vent passage and the venting element.

BACKGROUND OF THE INVENTION

Loudspeakers generally comprise a frame, a motor structure, a diaphragm, a lower suspension or spider and a surround or upper suspension. Speakers may be mounted within the interior of an enclosure having a front panel formed with an opening such that a forward-facing surface of the diaphragm aligns with the opening. Alternatively, speakers may be mounted to a baffle that attaches to or is integrally formed as part of a wall, ceiling or the like that defines an enclosed interior area where the speaker may be located.

Loudspeakers of the type described above which are intended for outdoor use, such as on vessels, patios or the like, employ upper suspensions and diaphragms that are weather-proof or at least weather-resistant. Such components are effective to help protect the loudspeaker and electrical components within the interior of the frame from exposure to the outside environment. In situations where the loudspeaker and its enclosure are exposed to direct sunlight and/or other sources of heat, air within the interior of the enclosure can become pressurized which may damage the loudspeaker and/or cause reduced acoustic performance unless such pressure is relieved.

The problem of over pressurization described above has been addressed in the prior art as illustrated, for example, in FIGS. 1 and 2. A loudspeaker enclosure 10 is depicted within which a loudspeaker (not shown) is mounted such that its diaphragm 12 aligns with an opening formed in the enclosure 10. Mounting structure 16 is provided for connecting the enclosure 10 to some type of support on a vehicle, patio or the like. In the illustrated example, the mounting structure 16 may include a base 18, typically integrally formed with the enclosure 10, a gasket 20, a mounting disc 22 and a clamp 24. The base 18 is formed with a vent opening 26 which receives an o-ring 28 and a porous metallic vent disc 30.

As seen in FIG. 2, the gasket 20 may be formed with a slot 32 and the mounting disc 22 may have a notch 34 which align with one another, and with the disc 30, when connected to the base 18 and enclosure 10. The clamp 24 overlies the mounting disc 22. When assembled, a leak path is provided for the escape of pressurized air from the interior of the loudspeaker enclosure 10, through the vent opening 26 and porous disc 22, and then out the aligning slot 32 in gasket 20 and notch 34 in mounting disc 22.

One disadvantage of the loudspeaker system described above is that the venting structure is integral with the loudspeaker enclosure 10. If it is desired to remove the loudspeaker from the interior of such enclosure 10 and utilize it in another application, or with a different type of enclosure, no venting would be provided in that new or different application unless present in the other enclosure.

SUMMARY OF THE INVENTION

This invention is directed to a loudspeaker having a one-piece frame integrally molded with a venting element which is located within a vent passage formed in a mounting flange of the frame. Pressurized air created by the application of heat to an enclosure within which the loudspeaker may be housed escapes from the enclosure interior through a leak path formed by the vent passage and the venting element.

In one presently preferred embodiment wherein the loudspeaker includes a grill assembly, one or more vent spaces are formed between the mounting flange of the frame and an element of the grill assembly which overlies the frame. The vent passage and vent space(s) cooperate with the venting element to define a leak path through which pressurized air from the interior of the enclosure may escape out of the enclosure.

As noted above, especially in situations where enclosures that house loudspeakers are exposed to high temperatures, the air located within the interior of such enclosures can become pressurized above ambient levels. As a result, the diaphragm of the speaker may be pushed outwardly from its normal position thus distorting the acoustic output of the loudspeaker and/or damaging the diaphragm. The provision of a leak path in the frame of the loudspeaker according to this invention solves the over-pressurization issue. Additionally, as distinguished from prior art loudspeakers wherein venting structure is provided in the enclosure, the loudspeaker with the vented frame of this invention may be removed from one enclosure or baffle, and used in a different one, while still providing the desired venting capability.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
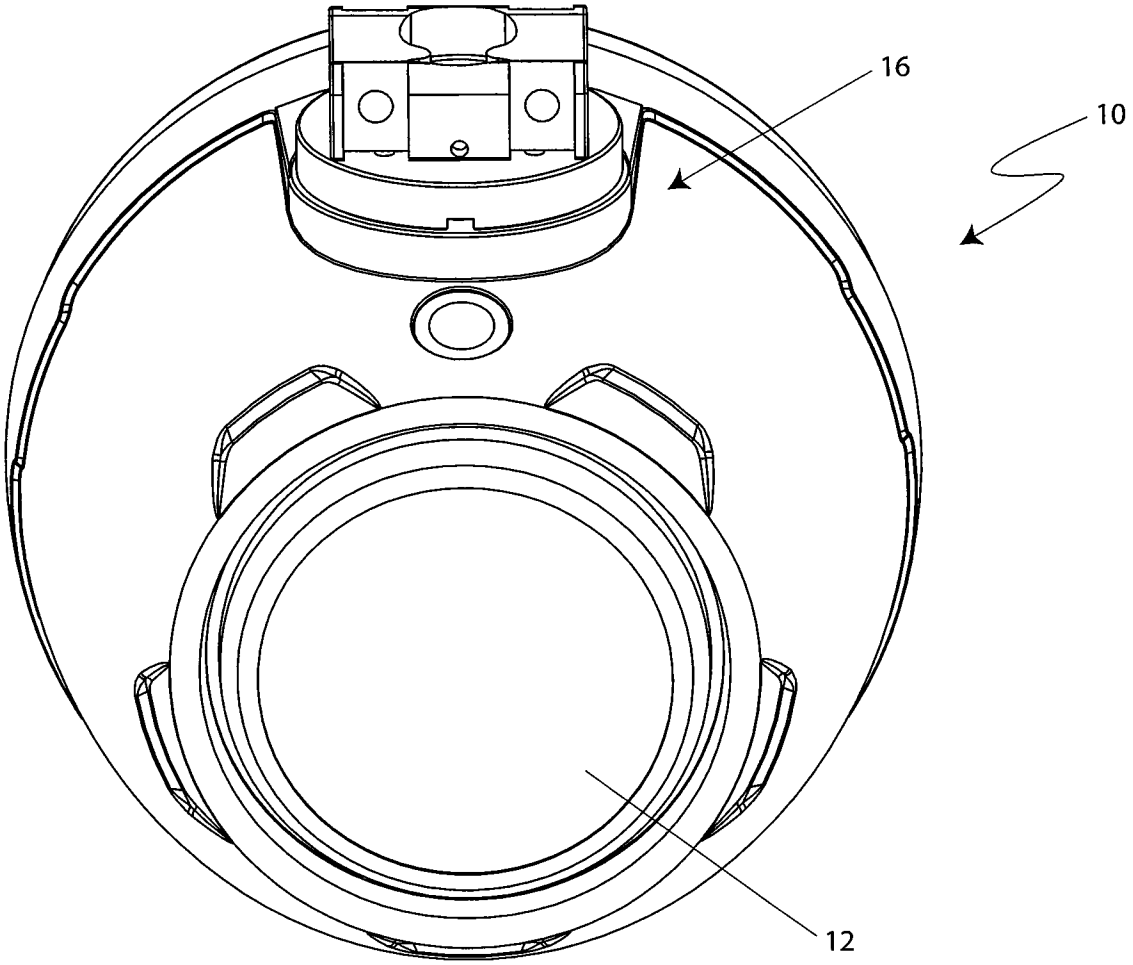
PRIOR ART FIG. 1
FIG. 1 is a perspective view of a prior art loudspeaker system with a speaker mounted within an enclosure having external mounting structure.
Figure 2:
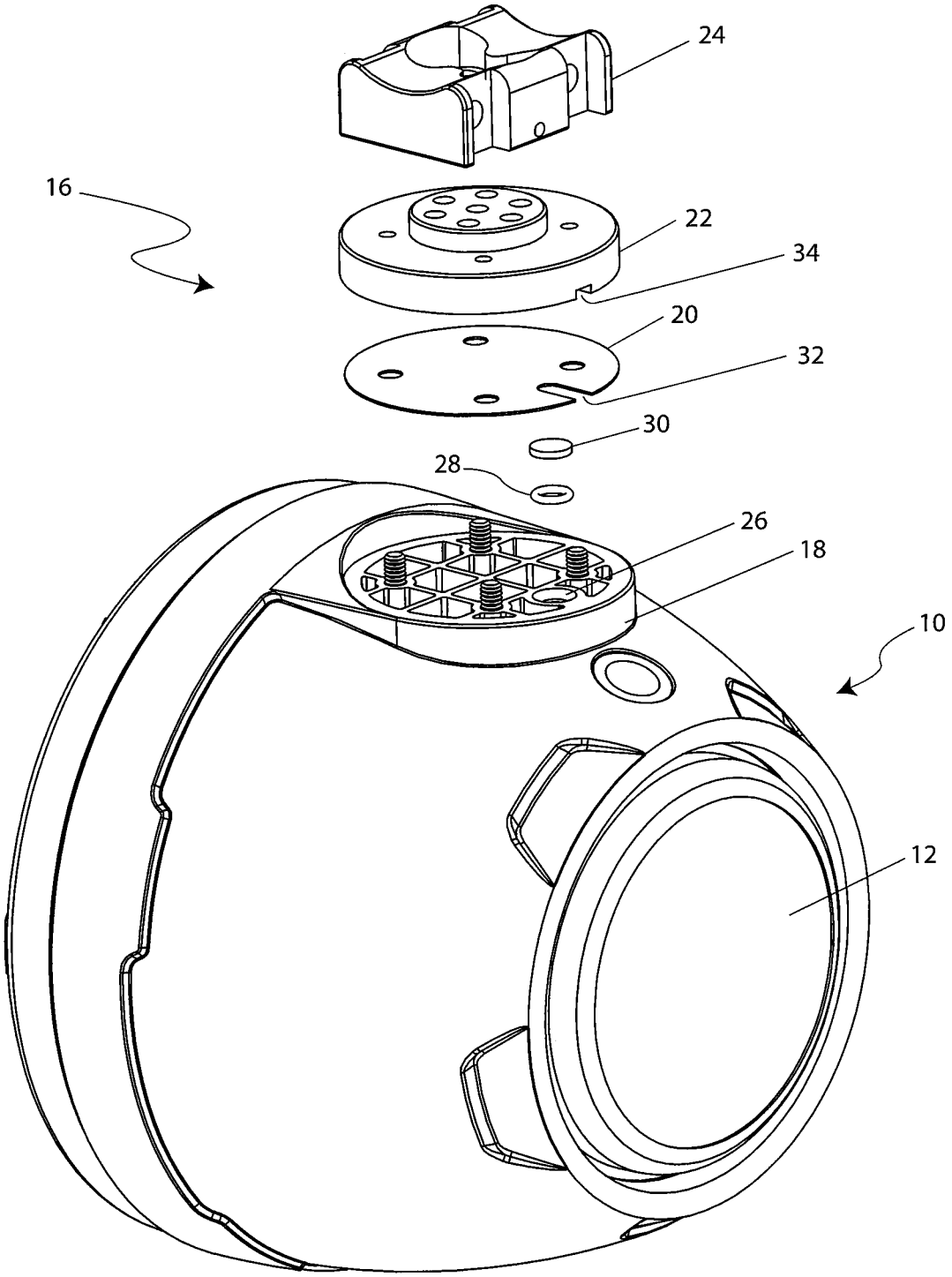
PRIOR ART FIG. 2
FIG. 2 is a perspective of the loudspeaker system shown in FIG. 1 in which the mounting structure, including a venting disc, is separated from the enclosure in an exploded view.
Figure 3:
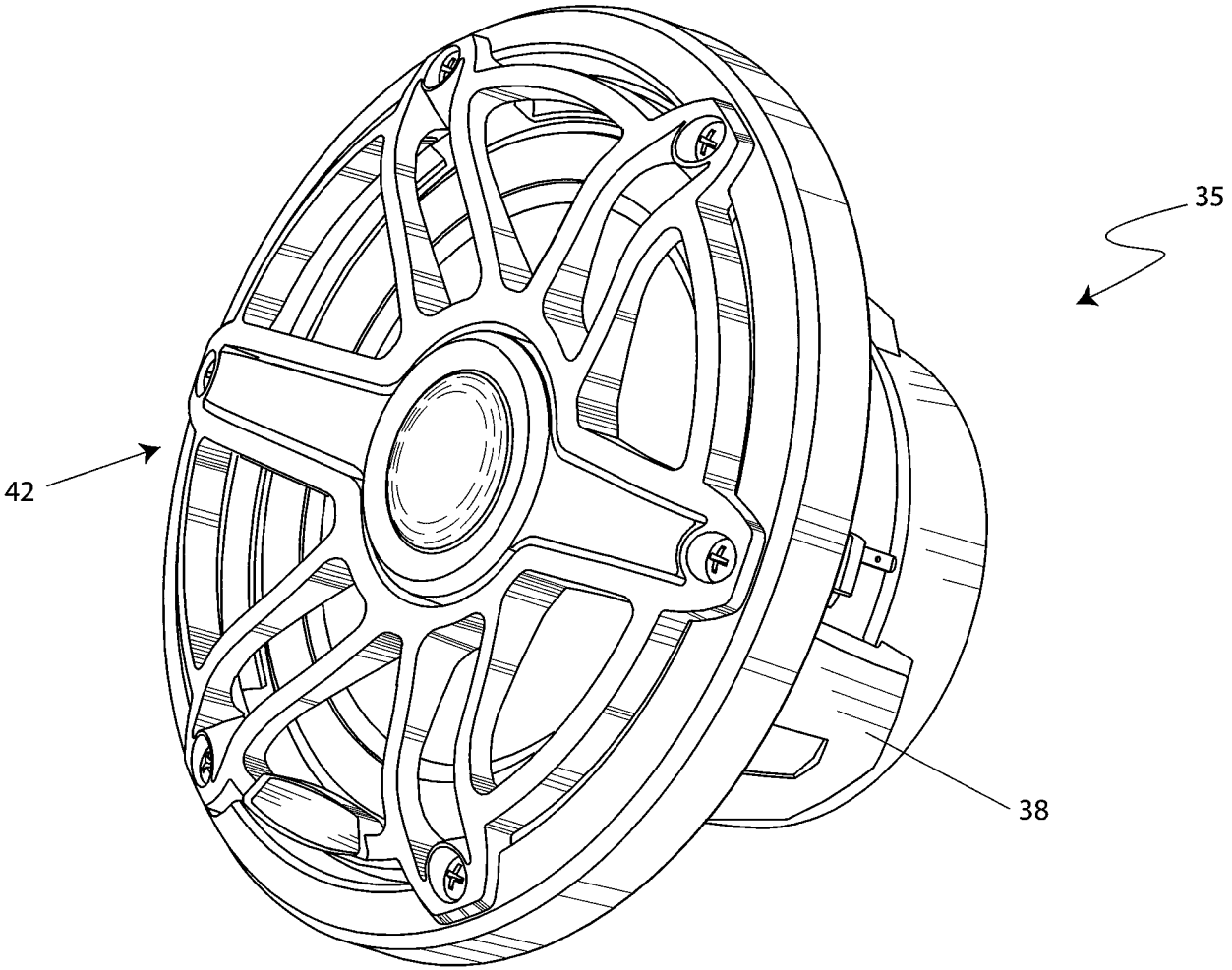
FIG. 3 is a perspective view of one embodiment of the loudspeaker of this invention.
Figure 4:
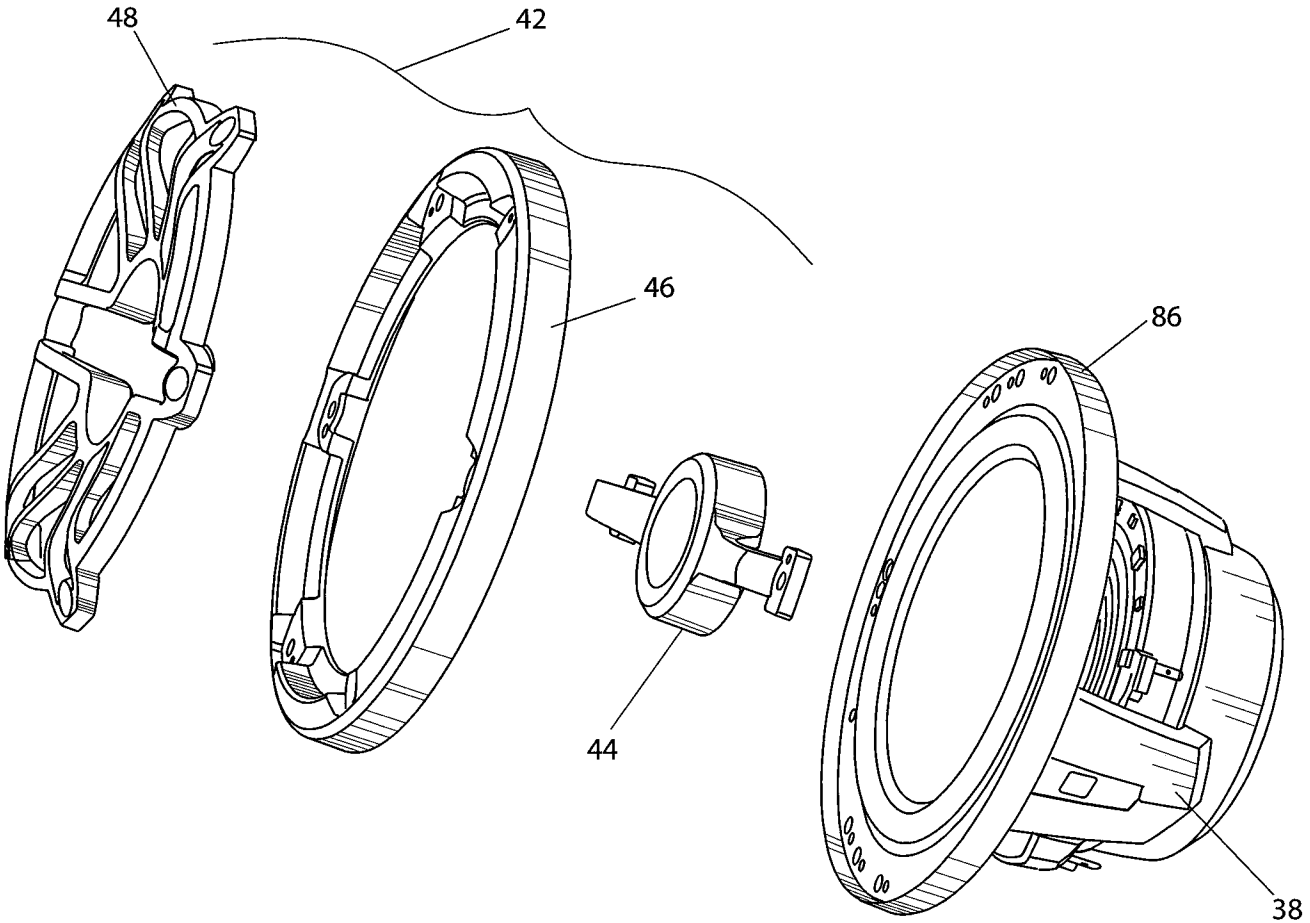
FIG. 4 is an exploded, perspective view of the loudspeaker of FIG. 3.
Figure 6:
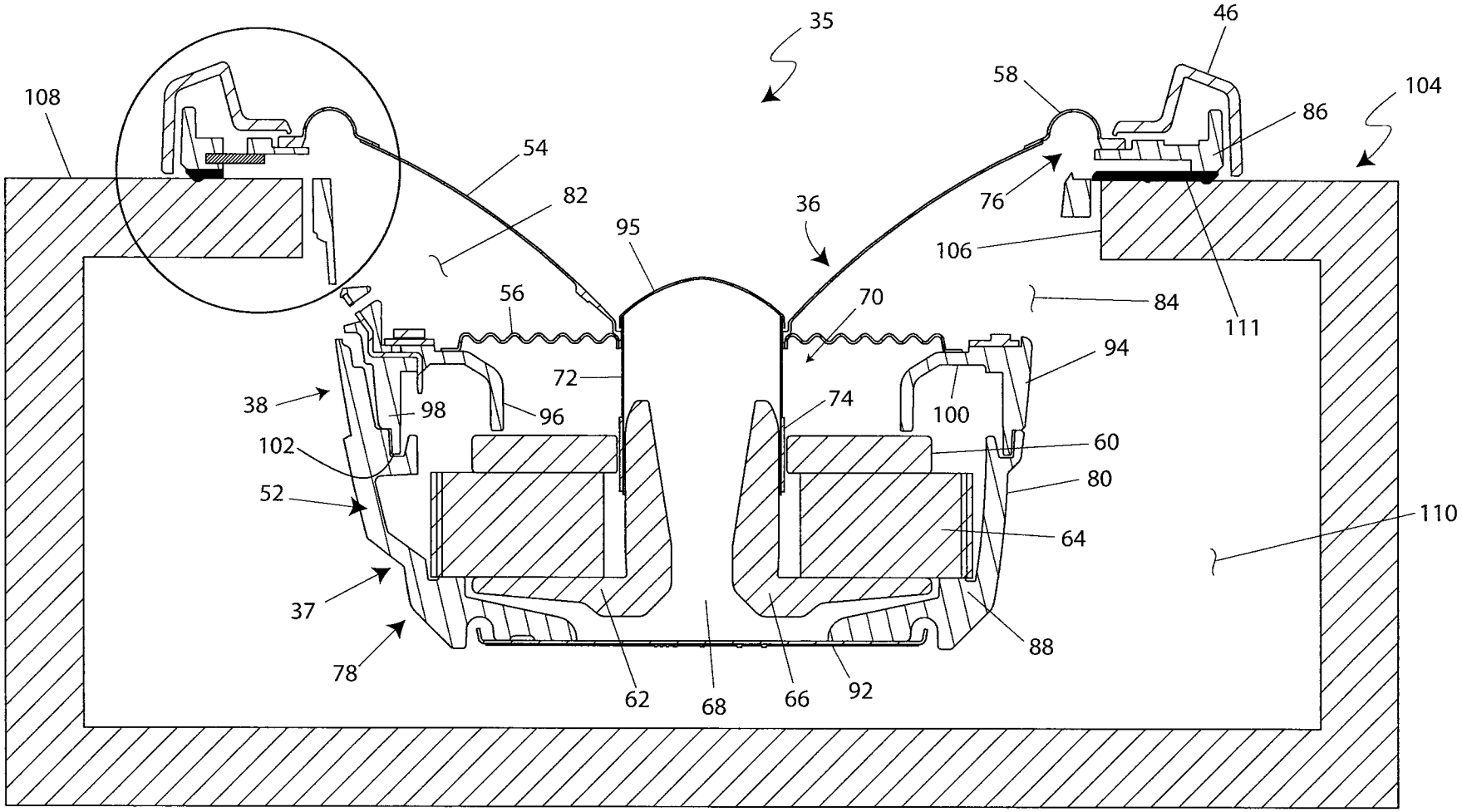
FIG. 6 is a partial cross sectional view of the loudspeaker illustrated in FIG. 3 mounted within an enclosure.

Referring initially to FIGS. 3, 4 and 6, the loudspeaker 35 of this invention generally comprises a moving assembly 36, a motor structure 37, a frame 38 and a grill assembly 42. Throughout the following description, the terms "top," "bottom," "upper" and "lower" are meant to refer to directions and/or locations with the loudspeaker 35 in the orientation shown in the Figs. The terms "inner" and "outer" refer to a radial relationship of parts or structure beginning at the longitudinal axis of the loudspeaker 35 which, for purposes of this discussion, is considered to pass through the center of the grill assembly 42.

The grill assembly 42 comprises a tweeter mount 44, a grill tray 46 and a grill 48, the details of which are disclosed in U.S. patent application Ser. No. 15/962,397, filed Apr. 25, 2018, the disclosure of which is hereby incorporated by reference in its entirety herein. Except as set forth below, the detailed construction of the grill assembly 42 forms no part of this invention and is therefore not discussed.

In one presently preferred embodiment, the moving assembly 36 of speaker 35 comprises a diaphragm 54, a lower suspension or spider 56 and an upper suspension or surround 58. The motor structure 37 comprises a top plate 60 and a back plate 62 which are spaced from one another and mount a permanent magnet 64 between them. A pole piece 66 having a bore 68 is integrally formed with and extends upwardly from the back plate 62 into a central opening formed in both the magnet 64 and top plate 60. A magnetic gap is formed between the top plate 60 and pole piece 66 within which lines of magnetic flux (not shown) are created by the permanent magnet 64. The moving assembly 36 further includes a voice coil 70 having a hollow, cylindrical-shaped former 72 whose outer surface mounts a wire winding 74. The former 72 is concentrically disposed about the pole piece 66, and the voice coil 70 is axially movable within the magnetic gap during operation of the speaker 35.

The frame 38 preferably has a one-piece molded construction formed of plastic by injection molding or other suitable molding process. The frame 38 has an upper end 76, a lower end 78 and a side wall 80 extending between them defining an interior 82. The side wall 80 may be formed with one or more openings or windows 84 to reduce weight and provide for circulation of air into the frame interior 82. The upper end 76 of frame 38 is formed with a flange 86, and its lower end includes an annular shelf 88. The magnet 64 of the motor structure 37 rests atop the shelf 88. Preferably, a base plate 92 extends along the lower end 78 of the frame 38 thus enclosing the motor structure 52 within the frame interior 82.

The voice coil 70 is held in place within the magnetic gap by the diaphragm 54, spider 56 and surround 58. A lower end of the diaphragm 54 is affixed to the former 72 of the voice coil 70 by adhesive or the like, and its upper end connects to the surround 58. The surround 58, in turn, is mounted to the flange 86 at the upper end 76 of the frame 38. The spider 56 has an inner edge affixed by adhesive or the like to the former 72 and an outer edge mounted to a spider stand-off ring 94. A dust cap 95 may be mounted to the outer surface of the diaphragm 54, in position above the voice coil 70, as depicted in FIG. 6.

In the presently preferred embodiment, the spider stand-off ring 94 includes an inner wall 96 and an outer wall 98 separated by a top wall 100 which mounts the outer end of spider 56. The spider stand-off ring 94 is mounted to the frame 38 by affixing its outer wall 98 within a channel 102 formed in the side wall 80 of the frame 38. In this position, the inner wall 96 of the spider stand-off ring 94 rests on the top plate 60 of the motor structure 37 where it may be secured in place such as by adhesive.

With reference to FIG. 6, the loudspeaker 35 is schematically illustrated as being secured within an enclosure 104. An opening 106 is formed in one wall 108 of the enclosure 104 through which the speaker 35 is inserted into the enclosure interior 110 except for the flange 86 on the upper end 76 of its frame 38. The flange 86 rests atop the wall 108 and preferably a gasket 111 is located between the flange 86 and wall 108 to create a weather-tight seal. The flange 86 may be connected to the wall 108 by screws (not shown).

With the speaker 35 positioned within the interior 110 of the enclosure 104, the grill assembly 42 may be mounted to the flange 86 at the upper end 76 of the frame 38 as depicted in FIG. 3. For ease of illustration, only the grill tray 46 of the grill assembly 42 is shown in position overlying the flange 86 at the upper end 76 of frame 38. See FIG. 6. It can be appreciated that once mounted within the enclosure 104, all of the components of the speaker 35 may be subjected to high temperatures if the enclosure 104 is exposed to sunlight or other heat sources. High temperatures within the enclosure 104 increases the pressure of the air within the interior 82 of the speaker frame 38, and in the enclosure interior 110, in direct proportion to the temperature increase. This increased pressure can cause the diaphragm 54 to bulge outwardly, in a direction toward the opening 106 in the wall 108 of the enclosure 104, thus potentially damaging the diaphragm 54 and/or distorting the acoustic output of the speaker 35.

Figure 5:
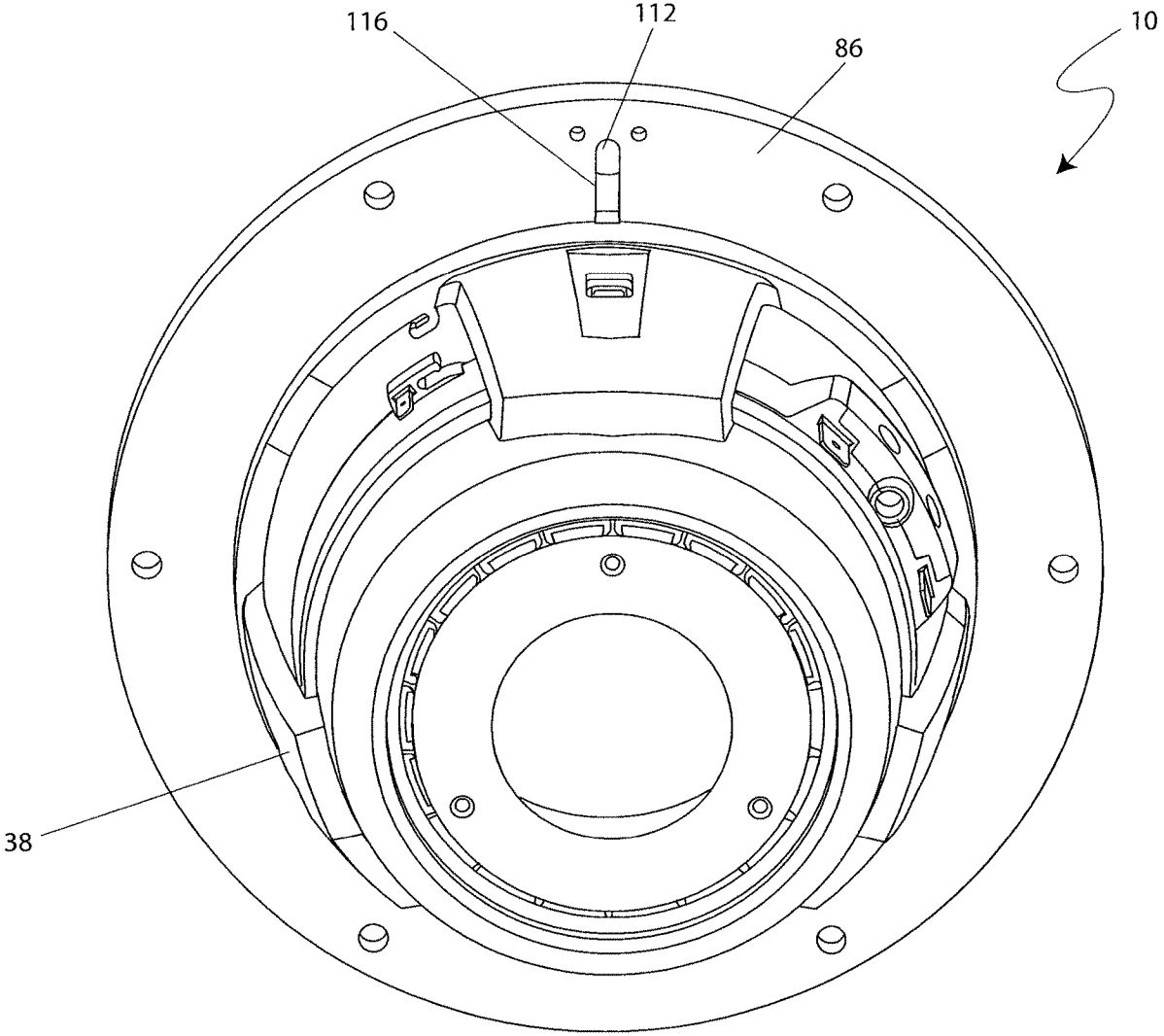
FIG. 5 is back view of the loudspeaker shown in FIG. 3.
Figure 7:
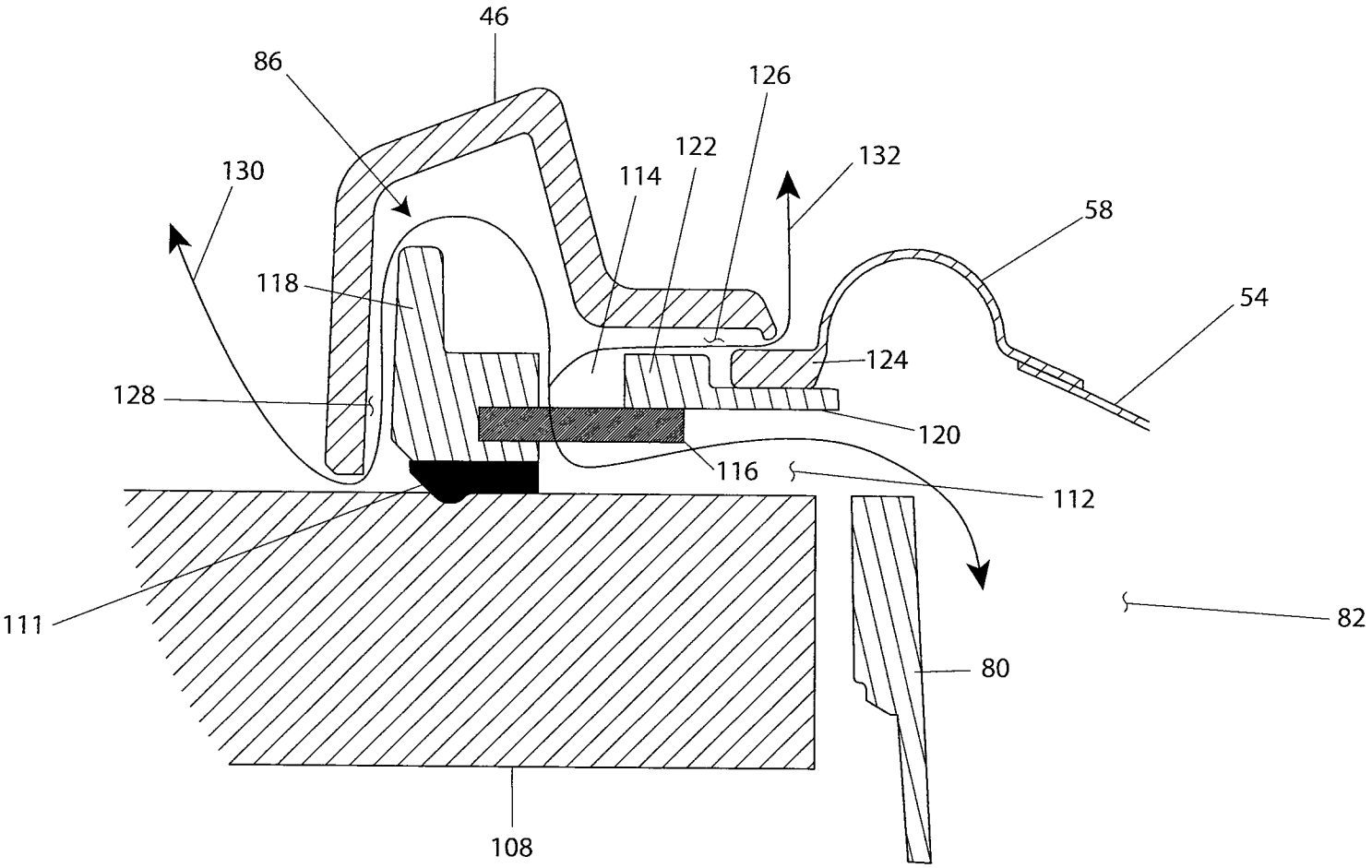
FIG. 7 is an enlarged view of the encircled part of the loudspeaker shown in FIG. 6.

An important aspect of this invention is the construction of frame 38 so as to provide a leak path for the escape of pressurized air from the interior 82 of the speaker 40 and interior 110 of the enclosure 104 out of the enclosure 104. With reference to FIG. 7, in the presently preferred embodiment the flange 86 at the upper end 76 of the frame 38 is formed with a slot or vent passage 112 which extends from the interior 82 of speaker 40 to an outlet bore 114 in the flange 86. A porous venting disc 116 is located within the vent passage 112 such that at least a portion thereof covers the outlet bore 114. See also FIG. 5. The venting disc 116 is integrally molded with the one-piece frame 38, i.e. in the case of injection molding, the venting disc 116 is placed within the mold after which plastic material is injected to form the frame 38. The venting disc 116 extends within an outer portion 118 of the flange 86 and against a wall 120 of an inner portion 122 of the flange 86 that defines part of the vent passage 112.

The venting disc 116 is preferably formed of 316L stainless steel and is commercially available from Applied Porous Technologies, Inc. of Tariffville, Conn. In the presently preferred embodiment, the venting disc 116 has a porosity in the range of 2 to 10 microns (micrometers) and an ingress protection rating ("IPR") of 67. In this context, the use of "microns" as the unit measurement of porosity refers to the diameter of the pores present in the venting disc 116. An IPR rating of 67 refers to properties of the venting disc 116 wherein no ingress of dust is permitted over a time period of two to eight hours, and protection is provided against the effects of immersion in water at a depth of between 15 centimeters and 1 meter for a period of thirty minutes.

The physical dimensions of the venting disc 116, e.g. diameter and thickness, are chosen according to the size of the loudspeaker 35. In particular, the thickness of the venting disc 116 is chosen according to the wall thickness of the flange 86 of frame 38. The diameter of the venting disc 116 depends on the space available in the flange 86 and the diameter of the vent passage 112. By way of example, for woofer loudspeakers 35 a venting disc 116 may be employed having a diameter of 0.375 inches, ±0.003 inches, a thickness of 0.062 inches±0.002 inches, and, a porosity of 2 microns. Tweeter loudspeakers 35 may employ a venting disc 116 having a diameter of 0.250 inches±0.003 inches, a thickness of 0.062 inches±0.002 inches, and, a porosity of 10 microns. Subwoofer loudspeakers 35 may employ a venting disc 116 having a diameter of 0.375 inches±0.003 inches, a thickness of 0.125 inches±0.002 inches, and, a porosity of 2 microns.

As discussed above, in one presently preferred embodiment the loudspeaker 35 of this invention may include a grill assembly 42 having a tweeter mount 44, a grill tray 46 and a grill 48. In FIGS. 6 and 7, a portion of the grill assembly 42 is illustrated in position relative to the frame 38. In particular, the grill tray 46 is shown overlying the flange 86 of frame 38 including its outer portion 118, its inner portion 122 and a ring 124 affixed to an outer edge of the surround 58 which mounts it to the flange 86. A first vent space 126 is formed between the inner portion 122 of flange 86 and the grill tray 46, and a second vent space 128 is formed between the outer portion 118 of flange 86 and grill tray 46. As seen in FIG. 7, the grill tray 46 does not contact the wall 108 of enclosure 104 and therefore the vent space 128 further extends between such components.

The vent passage 112, the venting disc 116, and the vent spaces 126, 128, collectively form a leak path denoted by arrows 130 and 132. Pressurized air from the interior 82 of the frame 38 and the enclosure interior 110 enters the vent passage 112, passes through the venting disc 116 and outlet bore 114, and, thereafter travels out through the vent spaces 126 and 128 exteriorly of the enclosure 104 as illustrated by arrows 130, 132. As discussed above, the porosity of the venting disc 116 is selected to allow for gradual escape or leaking of the pressurized air, while preventing the ingress of dust and water into the frame interior 82 and enclosure interior 110. As a result, over-pressurization and distortion of the diaphragm 54 is substantially prevented.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, the loudspeaker 35 of this invention is shown with a grill assembly 42 as described herein. The structure of the grill tray 46 which overlies the frame flange 86, as described above, forms part of the vent spaces 126, 128 allowing pressurized air to escape from the interior 110 of enclosure 104. It is contemplated that other grill constructions may be employed with the loudspeaker 35 of this invention so long as one or more vent spaces are provided between the grill and frame, and in communication with the venting disc 116 and vent passage 112, to form part of a leak path permitting escape of pressurized air from the enclosure 104. Additionally, in some applications a grill assembly may be eliminated such that the upper end 76 of the loudspeaker frame 38, the diaphragm 54, the upper suspension 58 and the dust cap 95 of the speaker 35 may be exposed. In that construction, pressurized air from the interior 110 of the enclosure 104 within which the speaker 35 is mounted may escape through a leak path defined by vent passage 112, vent opening 114 and venting disc 116.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a frame including a venting element, said frame having a frame interior and a first end, said frame having a mounting flange for mounting the loudspeaker in an enclosure through an opening in a wall of said enclosure with the mounting flange resting atop said wall peripherally of said opening, said enclosure having an enclosure interior, said mounting flange including a vent passage in communication with said frame interior;

said venting element being located within said vent passage, said venting element being effective to permit the passage of pressurized air through said venting element, said venting element and said vent passage forming part of a leak path which permits said pressurized air from said enclosure interior to escape out of said enclosure by way of said mounting flange;

a moving assembly and a motor structure, said moving assembly and said motor structure both being coupled to said frame.

2. The loudspeaker of claim 1 wherein said vent passage is a slot formed in said mounting flange, said slot extending between said frame interior and said first end.

3. The loudspeaker of claim 1 in which said venting element is a porous venting disc.

4. The loudspeaker of claim 1 in which said venting element is a porous venting disc having a porosity in the range of about 2 microns to 10 microns, a diameter in the range of about 0.250 inches to 0.375 inches, and a thickness in the range of about 0.062 inches to 0.125 inches.

5. A loudspeaker, comprising:

a molded frame including a venting element, said frame having an interior and a first end, said frame being formed with a vent passage in communication with said interior and said first end;

said venting element being located within said vent passage, said venting element being effective to permit the passage of pressurized air therethrough;

a grill assembly connected to said frame in position overlying said first end, at least one vent space being formed between a portion of said grill assembly and said first end, said vent passage, said venting element and said at least one vent space collectively forming a leak path;

a moving assembly and a motor structure coupled to said frame.

6. The loudspeaker of claim 5 in which said vent passage is a slot formed in said frame which extends between said interior and said first end.

7. The loudspeaker of claim 5 in which said venting element is a porous venting disc.

8. The loudspeaker of claim 7 in which said porous venting disc has a porosity in the range of about 2 microns to 10 microns.

9. The loudspeaker of claim 7 in which said porous venting disc has a diameter in the range of about 0.250 inches to 0.375 inches, and a thickness in the range of about 0.062 inches to 0.125 inches.

10. A loudspeaker, comprising:

a molded frame including a venting element, said frame having an interior and a first end, said frame being formed with a vent passage in communication with said interior and said first end;

said venting element being located within said vent passage and being effective to permit the passage of pressurized air therethrough;

a grill tray connected to said frame in position overlying said first end, at least one vent space being formed between said grill tray and said first end, said vent passage, said venting element and said at least one vent space collectively forming a leak path;

a grill mounted to said grill tray;

a moving assembly and a motor structure coupled to said frame.

11. The loudspeaker of claim 10 in which said vent passage is a slot formed in said frame which extends between said interior and said first end.

12. The loudspeaker of claim 10 in which said venting element is a porous venting disc.

13. The loudspeaker of claim 12 in which said porous venting disc has a porosity in the range of about 2 to 10 microns.

14. The loudspeaker of claim 12 in which said porous venting disc has a diameter in the range of about 0.250 inches to 0.375 inches, and a thickness in the range of about 0.062 inches to 0.125 inches.

15. A loudspeaker system, comprising:

a loudspeaker comprising:

(i) a molded frame including a venting element, said frame having a frame interior and a mounting flange, said frame being formed with a vent passage in communication with said frame interior and said mounting flange, said venting element being located within said vent passage, said venting element being effective to permit the passage of pressurized air therethrough;

(ii) a moving assembly and a motor structure coupled to said frame;

an enclosure having an enclosure interior and a panel formed with an opening, said loudspeaker being located within said enclosure interior with said mounting flange thereof connected to said panel such that acoustic output from said loudspeaker is directed toward said opening in said panel;

a grill assembly connected to at least one of said panel and said mounting flange;

at least one vent space being formed between said grill assembly and at least one of said mounting flange and said panel, said vent passage, said venting element and said at least one vent space collectively forming a leak path for the escape of pressurized air out of said enclosure interior.

16. The loudspeaker system of claim 15 in which said venting element is a porous venting disc having a porosity in the range of about 2 microns to 10 microns, a diameter in the range of about 0.250 inches to 0.375 inches, and a thickness in the range of about 0.062 inches to 0.125 inches.

* * * * *